US010451068B2

(12) United States Patent
Crum et al.

(10) Patent No.: US 10,451,068 B2
(45) Date of Patent: Oct. 22, 2019

(54) TIP SEAL

(71) Applicant: TRANE INTERNATIONAL INC., Piscataway, NJ (US)

(72) Inventors: Daniel R. Crum, Huntersville, NC (US); Joseph E. Ziolkowski, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 329 days.

(21) Appl. No.: 14/936,293

(22) Filed: Nov. 9, 2015

(65) Prior Publication Data

US 2016/0131136 A1 May 12, 2016

Related U.S. Application Data

(60) Provisional application No. 62/076,640, filed on Nov. 7, 2014.

(51) Int. Cl.

| | |
|---|---|
| ***F01C 1/063*** | (2006.01) |
| ***F03C 2/02*** | (2006.01) |
| ***F04C 18/063*** | (2006.01) |
| ***F04C 2/063*** | (2006.01) |
| ***F01C 19/08*** | (2006.01) |
| ***F01C 19/10*** | (2006.01) |
| ***F04C 27/02*** | (2006.01) |
| ***F16J 15/447*** | (2006.01) |
| ***F04C 27/00*** | (2006.01) |

(Continued)

(52) U.S. Cl.

CPC ..... *F04C 27/005* (2013.01); *F04C 18/0215* (2013.01); *F04C 18/0284* (2013.01); *F04C 23/008* (2013.01)

(58) Field of Classification Search

CPC ..... F04C 27/005; F04C 18/0215; F04C 18/0284; F16J 15/3456; F16J 15/3484; F16J 9/02–9/28; F01C 19/005; F01C 19/10

USPC ..... 418/55.1, 55.4, 142, 140, 55.2, 141; 277/357, 96.2

See application file for complete search history.

(56) References Cited

U.S. PATENT DOCUMENTS 4,309,039 A * 1/1982 Irick ..... F16J 15/004 220/378
4,411,605 A * 10/1983 Sauls ..... F01C 19/08 277/412

(Continued)

FOREIGN PATENT DOCUMENTS

EP 1132573 A2 9/2001
GB 2108201 A 5/1983

(Continued)

OTHER PUBLICATIONS

English Translation of JP 06323101 by Espancenet, Jan. 9, 2019.*

(Continued)

*Primary Examiner* — Deming Wan
(74) *Attorney, Agent, or Firm* — Hamre, Schumann, Mueller & Larson, P.C.

(57) ABSTRACT

A tip seal for scroll wraps in a scroll compressor is provided. The tip seal may include surface features to form a tortuous flow path in a seal groove of a scroll wrap. The surface features can help form one or more contraction and/or expansion areas in the tortuous flow path. The tortuous flow path can help provide resistance to fluid flow and help reduce leakage through the seal groove.

15 Claims, 10 Drawing Sheets

(51) Int. Cl.
*F04C 18/02* (2006.01)
*F04C 23/00* (2006.01)

(56) References Cited

U.S. PATENT DOCUMENTS 4,415,317 A * 11/1983 Butterworth ..... F04C 18/0215 277/379
4,564,343 A * 1/1986 Nakamura ..... F04C 27/005 277/379
5,105,634 A 4/1992 Utter
6,126,422 A 10/2000 Crum et al.
6,270,713 B1 8/2001 Crum et al.
8,747,087 B2 * 6/2014 Collie ..... F01C 19/005 418/142
8,967,986 B2 * 3/2015 Harashima ..... F01C 19/005 277/357
2011/0070116 A1 3/2011 Harashima et al.
2012/0134683 A1 5/2012 Xie et al.
2012/0134863 A1 * 5/2012 Collie ..... F01C 19/005 418/55.1
2016/0238007 A1 * 8/2016 Kanemitsu ..... F04C 18/0284

FOREIGN PATENT DOCUMENTS

JP 0311101 A 1/1991
JP 06323101 A * 11/1994 ..... F04C 27/005
JP 07229485 A 8/1995
JP H09250466 A 9/1997
JP 2001-123970 5/2001
JP 2004-92480 A 3/2004
JP 2013-501888 A 1/2013

OTHER PUBLICATIONS

Danish Office Action, dated Aug. 26, 2016, Danish Patent Application No. PA201570722 (8 pages).
Office Action, Danish Patent Application No. PA201570722, dated Oct. 31, 2017 (6 pages).

* cited by examiner

TIP SEAL

FIELD

The disclosure herein relates to a compressor in, for example, a heating, ventilation and air conditioning (HVAC) system. More specifically, the disclosure herein relates to a tip seal for a scroll compressor in a HVAC system.

BACKGROUND

A scroll compressor generally refers to a fluid compression and expansion apparatus that includes two scroll members including interfitting spiroidal or involute scroll wraps, which are generated about respective axes. One representative scroll wrap includes flank surfaces, which adjoin in moving line contact, or near contact, the flank surfaces of the other respective scroll wrap to form a plurality of moving compression chambers. Depending upon the relative motion of the scroll wraps, the chambers move from the radial exterior end of the scroll wraps to the radially interior ends of the scroll wraps for fluid compression, or from the radially interior end of the scroll wraps to the radially exterior end of the scroll wraps for fluid expansion.

Scroll apparatuses are typically provided with a tip seal on the tip surface of the scroll wrap. The tip seal may be disposed in a tip seal groove formed in the tip surface. The tip seal can help prevent/reduce fluid leakage between the plurality of moving compression chambers.

In a HVAC system, a scroll compressor may be used to compress refrigerant with the notion that a scroll compressor can also be suitably used in other fluid compression systems.

SUMMARY

The embodiments disclosed herein are directed to a tip seal of a compressor, more particularly a scroll compressor. Generally, the tip seal includes a side with surface features that can help provide a tortuous fluid path when the tip seal is positioned, for example, in a seal groove. Generally, the surface features can provide resistance to a fluid flow when the fluid flows across the tip seal. The tip seal can help prevent/reduce leakage in the compressor, e.g. a by-pass leakage.

The embodiments as disclosed herein can generally be applicable to a scroll wrap in a scroll compressor. The embodiments described herein of the tip seal can also generally be suitable for use with other apparatuses or applications that may make use of its advantages.

In some embodiments, a tip seal for a scroll wrap in a scroll compressor may have a first side along a length of the tip seal, and a second side along the length of the tip seal. In some embodiments, the first side may include surface features configured to provide resistance to a fluid flow when the fluid flow is flowing along the length of the tip seal. In some embodiments, the second side may be configured to be pushed against the scroll wrap during operation of the scroll compressor to provide sealing. In some embodiments, the second side may be relatively smooth compared to the first side.

In some embodiments, the first side may include surface features that include a plurality of protruding structural elements. In some embodiments, the plurality of structural elements may have a width, and the width of the plurality of protruding structural element may be substantially perpendicular to the length L. In some embodiments, the plurality of protruding structural elements may be spaced apart along the length of the tip seal.

Other features and aspects of the systems, methods, and control concepts will become apparent by consideration of the following detailed description and accompanying drawings.

BRIEF DESCRIPTION OF THE DRAWINGS

FIG. 2A illustrates a partial sectional view of the scroll compressor. FIG. 2B illustrates a sectional view of scroll wraps of the scroll compressor for example along a line 2B-2B in FIG. 2A.

FIG. 3A illustrates an isometric view of the tip seal. FIG. 3B illustrates a sectional view along a line similar to a line 3B-3B in FIG. 2B, which illustrates scroll wraps with a tip seal installed. FIG. 3C is a partial close-up view of FIG. 3B. FIG. 3D is a partial close-up view of a portion 3D in FIG. 3A.

FIGS. 4A to 4C illustrate cross section views of embodiments of tip seal with different surface features. FIG. 4D is an enlarged view of area 4D in FIG. 4C.

Reference is now made to the drawings in which like reference numbers represent corresponding parts throughout.

DETAILED DESCRIPTION

A scroll compressor may be used in a HVAC system or other suitable applications to compress a fluid (e.g. refrigerant). The scroll compressor typically includes scroll wraps to compress the fluid. The scroll wraps may be provided with a tip seal on a tip surface of the scroll wraps. In some cases, the tip seal may be disposed in a tip seal groove formed in the tip surface. The tip seal can help provide sealing between moving chambers formed by the scroll wraps.

The embodiments as disclosed herein relate to a tip seal. In some embodiments, the tip seal may include surface features to help form a tortuous flow path in the seal groove of the scroll wraps. In some embodiments, the surface features can help form one or more contraction and/or expansion areas in the tortuous flow path. In some embodiments, the surface features can include protruding and/or depressing structures from the surface of the tip seal. The surface features may include e.g. rough surface features, random surface features, mixed geometries, combined geometries, and/or labyrinth geometry feature, which can include regular and/or irregular surface patterns. The tortuous flow path can help provide resistance to fluid flow and help reduce, for example, a by-pass leakage through the seal groove.

References are made to the accompanying drawings that form a part hereof, and in which is shown by way of illustration of the embodiments which may be practiced. It is to be understood that the terms used herein are for the purpose of describing the figures and embodiments and should not be regarded as limiting in scope.

Figure 1:
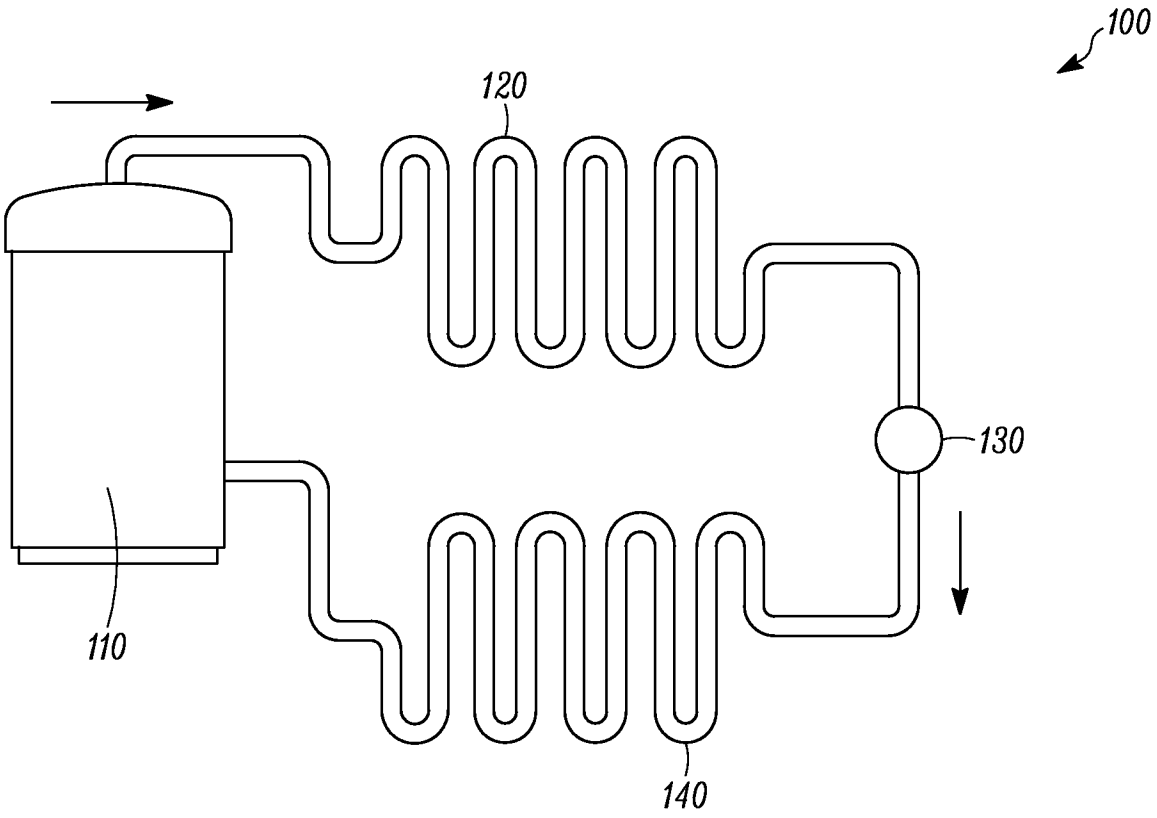
FIG. 1 illustrates a schematic diagram of a HVAC system, with which the embodiments as disclosed herein may be practiced.

FIG. 1 illustrates a schematic diagram of a typical HVAC system 100, which includes a compressor 110, a condenser 120, an expansion device 130 and an evaporator 140. The compressor 110 may be configured to compress a refrigerant. In some embodiments, the compressor 110 can be a scroll compressor. The embodiments disclosed herein can be used with the HVAC system 100 as illustrated or other HVAC systems, with the appreciation that the embodiments as disclosed herein can also be suitably used in other applications.

Figure 2A:
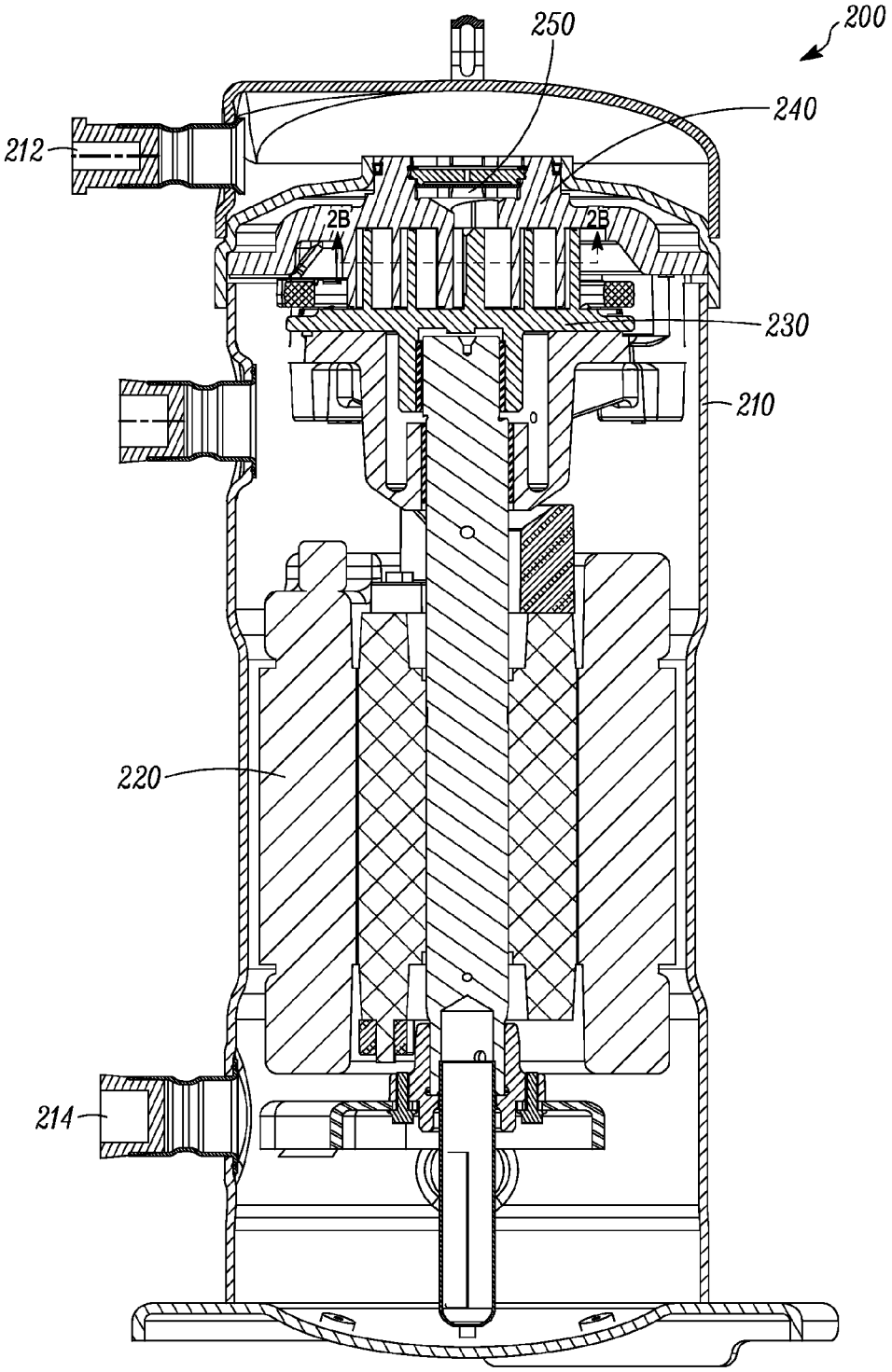
FIGS. 2A and 2B illustrate a scroll compressor.

FIG. 2A illustrates a scroll compressor 200. The scroll compressor 200 includes an enclosure 210, a motor 220 configured to drive a first scroll wrap 230, and a second scroll wrap 240.

Refrigerant can be directed into the scroll compressor 200 through an inlet 214. The refrigerant can be compressed by the first and second scroll wraps 230, 240, and directed out of the scroll compressor 200 through a discharge port 250 and an outlet 212.

Figure 2B:
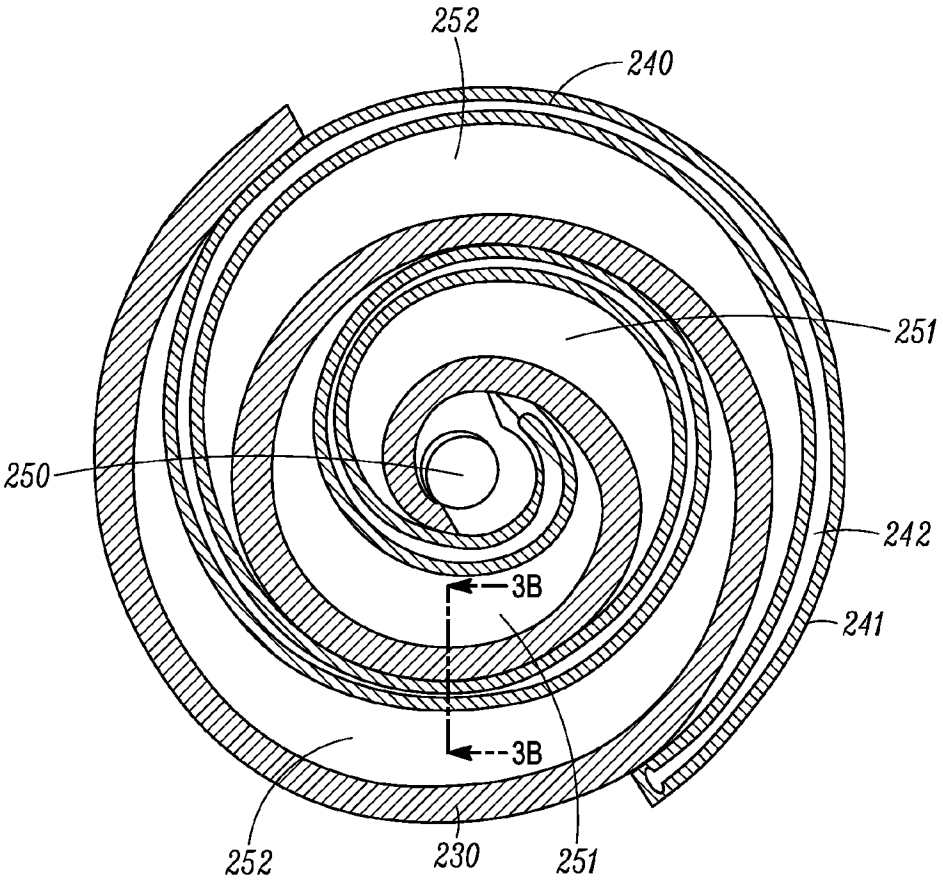

Referring to FIG. 2B, a sectional view of the first and second scroll wraps 230, 240 taken for example from a line 2B-2B in FIG. 2A is shown. As illustrated, the first and second scroll wraps 230, 240 can form a plurality of moving compression chambers (e.g. a first moving compression chamber 251 and a second moving compression chamber 252). Fluid (e.g. refrigerant) can be compressed in the moving chambers 251, 252, and the compressed fluid can be directed out of the scroll compressor 200 from the discharge port 250.

A tip surface 241 of the first scroll wrap 240 may include a seal groove 242. The seal groove 242 may be configured to receive a tip seal. For example, FIGS. 3A to 3D illustrate one embodiment of a tip seal 300 that can be disposed in a seal groove (e.g. the seal groove 242) of a scroll wrap.

Figure 3A:
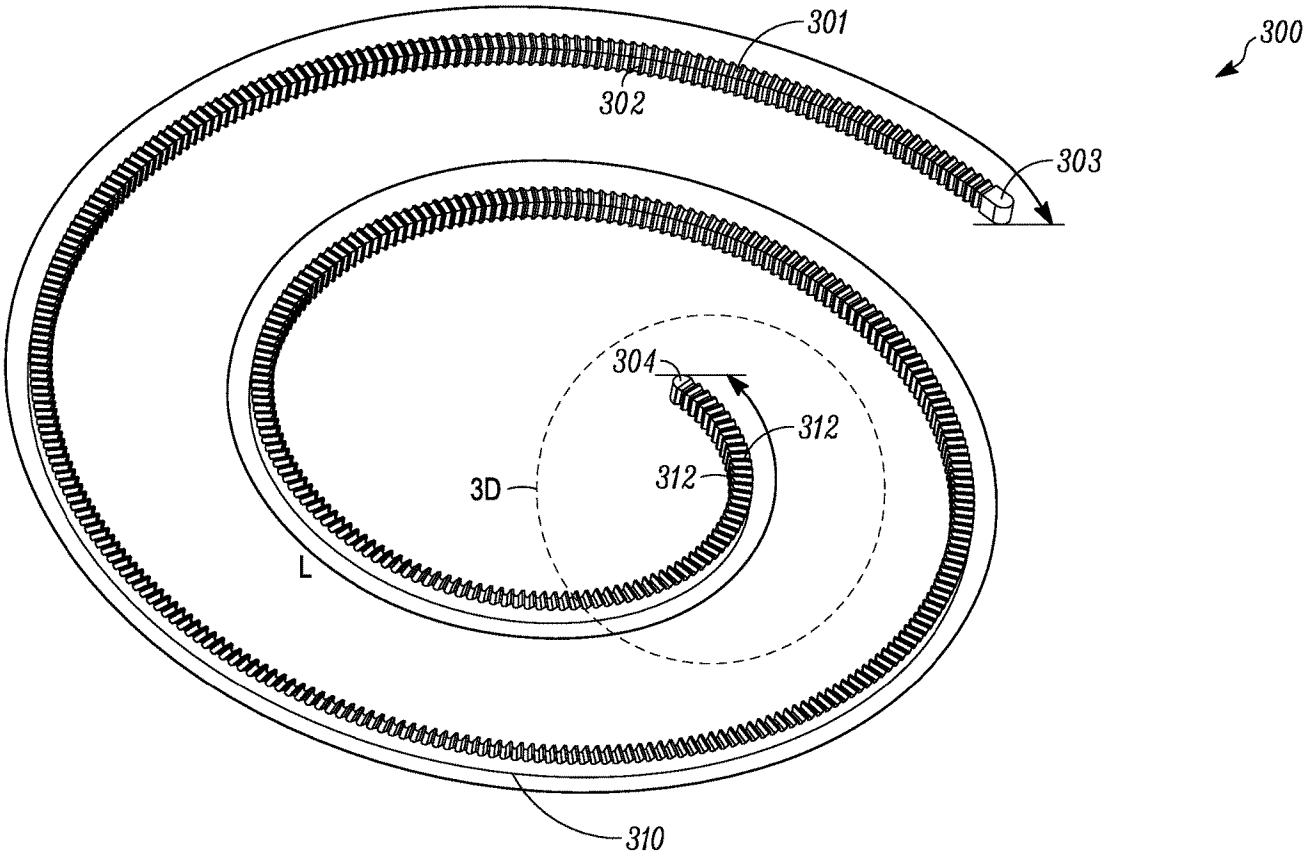
FIGS. 3A to 3D illustrate a tip seal with surface features, according to one embodiment.

Referring to FIG. 3A, the tip seal 300 shown has a substantially rectangular cross section. The tip seal 300 may include at least one relatively smooth side 310, and at least one side (e.g. the first and second sides 301, 302) that is relatively rough (e.g. including surface features 312). As illustrated in FIG. 3C, the first and second sides 301 and 302 may be positioned to provide a tortuous flow path in a by-pass leakage 343 formed between the tip seal 300 and the seal groove 342. (Further described below with respect to FIGS. 3B-3C.)

The tip seal 300 has a first end 303 and a second end 304. In some embodiments, the surface features 312 may generally occupy an entire length L of the tip seal 300 between the first and second ends 303, 304. In some embodiments, the surface features 312 may partially occupy the length L of the tip seal 300, for example, to save on the manufacturing cost of the tip seal 300 without sacrificing much of the performance advantages. In some embodiments, the surface features 312 may partially occupy a portion of the length L that is relatively close to the second end 304. In some embodiments, the portion relatively close to the first end 303 may be relatively smooth or may not include surface features for a tortuous path such as surface features 312. In the illustrated embodiment, the second end 304 is relatively closer to a discharge port (e.g. the discharge port 250 in FIG. 2B) than the first end 303. In some embodiments, there may be relatively more surface features, e.g. higher density of 312, proximate end 304 compared to end 303 or vice versa. In some embodiments, the density of the surface features may decrease from end 304 to end 303 or vice versa.

Figure 3B:
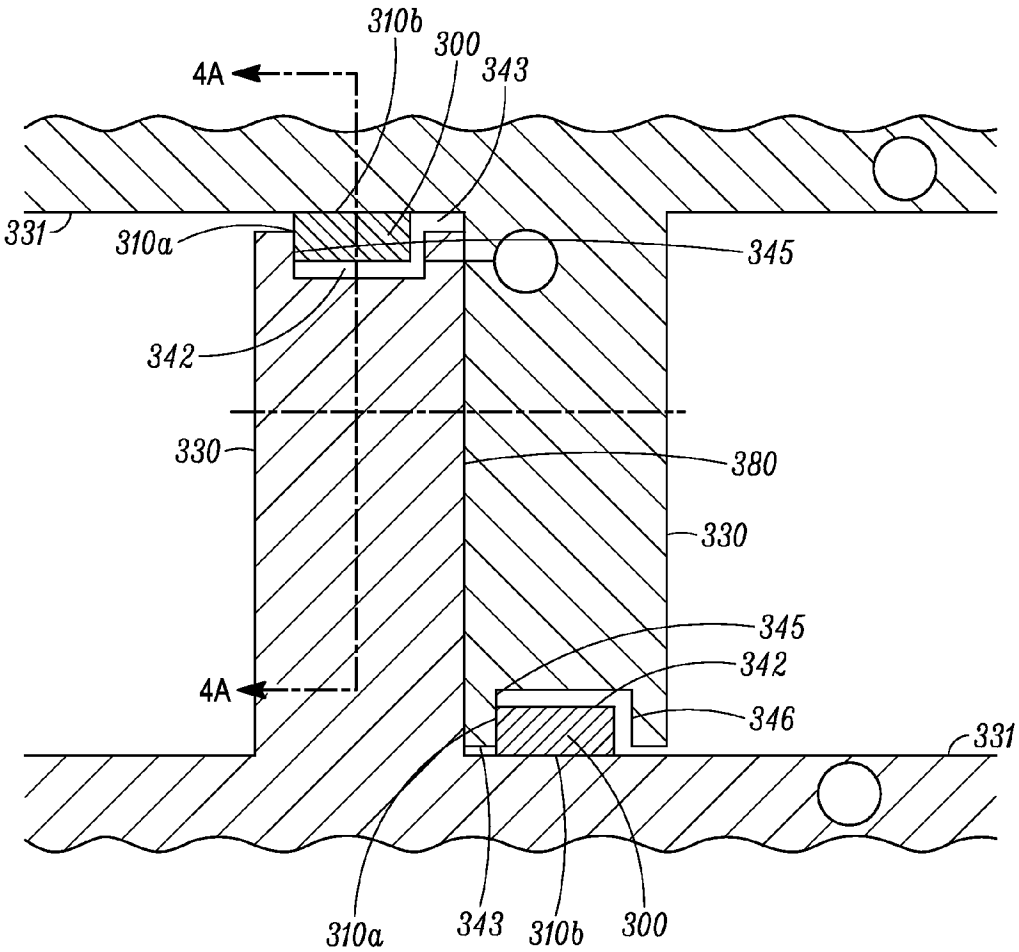
Figure 3C:
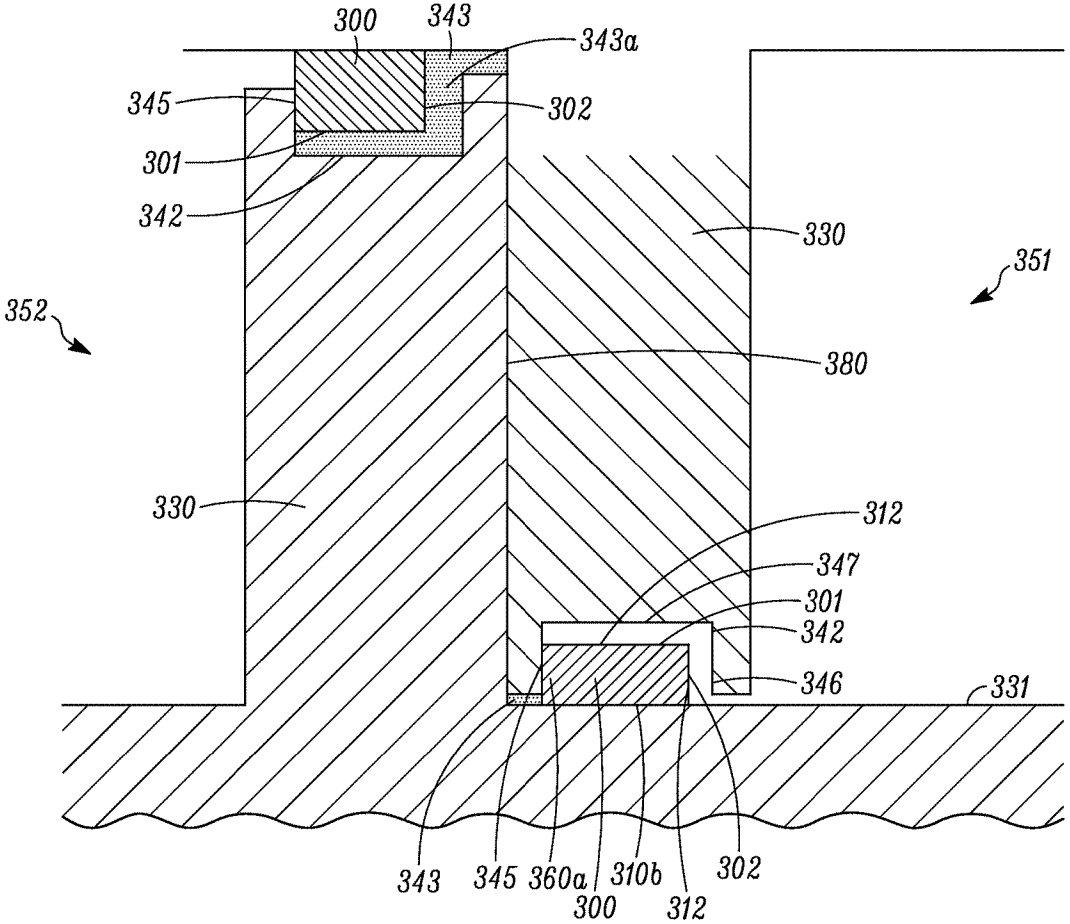

FIG. 3B illustrates a sectional view taken along, for example, a line 3B-3B in FIG. 2B. FIG. 3B illustrates the tip seal 300 positioned in seal grooves 342 of scroll wraps 330. It will be appreciated that one of the scroll wraps (not both) may have groove and tip seal. In the illustrated embodiment, cross sections of the tip seal 300 and the seal groove 342 can have a rectangular shape. The seal groove 342 is typically larger than the tip seal 300. In operation, the tip seal 300 can float in the seal groove 342 and be pushed against the base 331 of the scroll wrap 330 by, for example, compressed fluid. As illustrated in FIGS. 3B and 3C, in operation, the relatively smooth surfaces 310 (or non tortuous surface) of the tip seal 300 (illustrated in FIG. 2B as surfaces 310*b* and 310*a* respectively) can provide sealing with the base 331 of the scroll wrap 330 and a seal wall 345 of the seal groove 342.

It is to be appreciated that the cross section shapes of the tip seal 300 and the seal groove 342 are for illustration only. The cross section shapes of the tip seal 300 and the seal groove 342 can be configured to include shapes other than the rectangular shape shown in FIGS. 3B and 3C.

Referring to FIG. 3C, the by-pass leakage 343 (dotted shaded area) is typically located between two neighboring first and second compressing chambers 351, 352, where the first compressing chamber 351 has a relatively higher pressure compared to the second compressing chamber 352. The by-pass leakage 343 provides a leakage fluid passage between the compressing chambers 351, 352, causing compressed fluid in the compressing chamber 351 to leak to the compressing chamber 352 through the by-pass leakage 343.

Figure 3D:
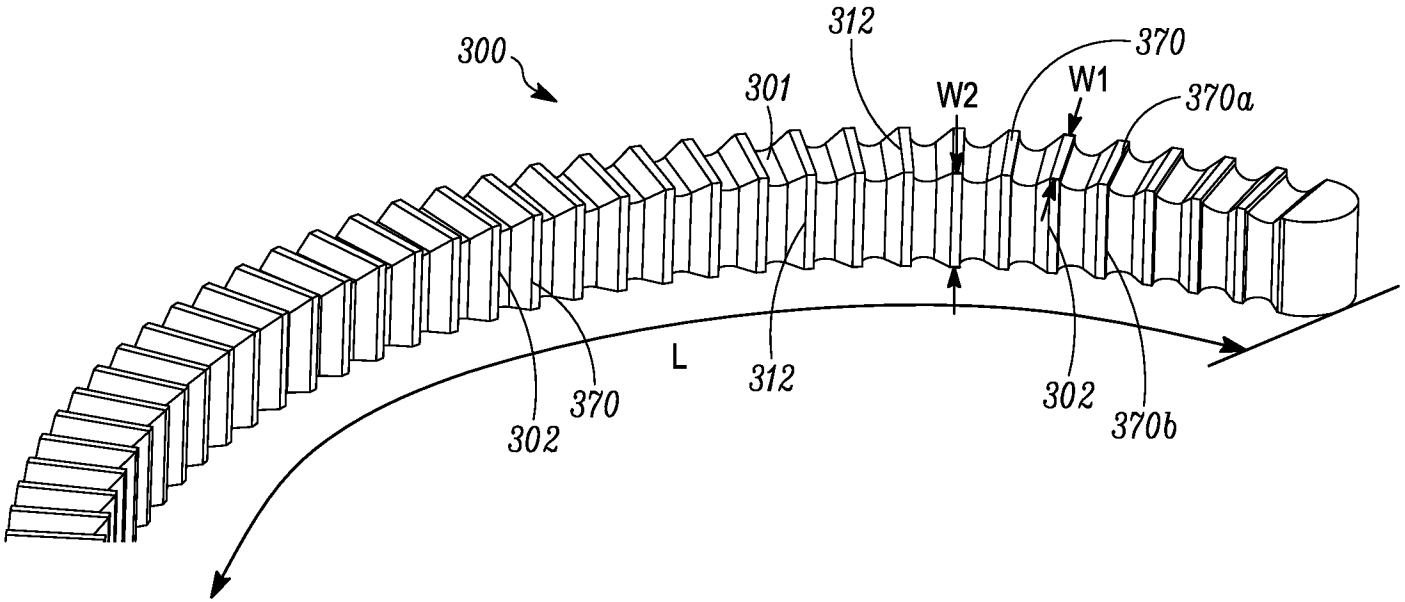

The tip seal 300 may include surface features 312 (as illustrated in FIGS. 3A and 3D) that help form a tortuous flow path to help prevent or at least reduce leakage through the by-pass leakage 343.

Referring to FIG. 3D, the surfaces features 312 of the tip seal 300 may include structural elements 370. The structural elements 370 may be generally configured to provide resistance to fluid flow when fluid flows across the surfaces features 312. In the illustrated embodiment, the structural elements 370 may include protruding structures along the length L of the tip seal 300 (see FIG. 3A). In the illustrated embodiments, some of the structural elements 370 are spaced apart along the entire length L, and one or more structural elements 370 generally extend transversely relative to the length L. Referring to both FIGS. 3C and 3D, when the tip seal 300 is positioned in the seal groove 342, the structural elements 370 can force fluid flow to expand or contract when flowing across the surface features 370, which can help provide resistance to the fluid flow so as to prevent or at least reduce leakage through the by-pass leakage 343.

The tip seal 300 in the illustrated embodiment can have a rectangular shaped cross section along the length L. The structural elements 370 may include protruding structures 370*a* and 370*b*, corresponding to the first and second sides 301 and 302 of the rectangular shaped cross section respectively. The protruding structures 370*a* and 370*b* have width w1 and w2 respectively. The width w1 and the width w2 extend in directions that are substantially perpendicular relative to the length L. Since the fluid flows in a direction along the length L, the configurations of the protruding structures 370*a* and 370*b* (e.g. the geometry of the width w1 and w2) can help provide resistance to the fluid flowing along the length L.

Referring to FIGS. 3B, 3C and 3D together, in the illustrated embodiment, the seal groove 342 generally has a rectangular shaped cross section and the tip seal 300 also has a rectangular shaped cross section. The seal groove 342 is generally larger than the tip seal 300. The tip seal 300 generally includes two relatively smooth surfaces 310 (e.g. 310*a*, 310*b*). In operation, the smooth surfaces 310 typically are pushed against the seal wall 345 of the seal groove 342 and the base 331 of the scroll wrap 330, which can help provide sealing on the seal wall 345 and the base 331.

Referring to FIGS. 3B and 3C, the first moving compression chamber 351 has a relatively high pressure than the second moving compression chamber 352. In the first moving compression chamber 351, a pressure from the first moving compression chamber 351 may push the tip seal 300 against the seal wall 345 of the seal groove 342, where the seal wall 345 is relatively close to the interface 380. In the second moving compression chamber 352, the pressure from the first moving compression chamber 351 may push the tip seal 300 against the seal wall 345 of the seal groove 342 in the second moving compression chamber 352, where the seal wall 345 is relatively further away from the interface 380. Consequently, with the respect to the leakage passage 343 formed between the first moving chamber 351 and the second moving chamber 352, a portion of the leakage passage 343 in the second moving compression chamber 352 (e.g. a leakage passage of the second moving compression chamber 343*a* in FIG. 3C) is relatively larger than the leakage passage 343 of the first moving compression chamber.

The first and second sides 301, 302 of the tip seal 300 may include structural elements 370 (as illustrated in FIG. 3D) to provide resistance to the fluid flow by forming a tortuous flow path in the seal groove 342. With the respect to the leakage passage 343, the structural elements 370 on the first and second sides 301, 302 of the tip seal 300 can provide the tortuous flow path in the seal groove 342 to reduce refrigerant by-pass through the leakage passage 343 in the seal groves 342 of both the first moving compression chamber 351 and the second moving compressor chamber 352. In some embodiment, because the leakage passage 343 in the second moving compression chamber 352 is relatively larger, the effect of the tip seal 300 in the seal groove 342 of the second moving compression chamber 352 may be more prominent.

It is to be appreciated that in some embodiments, cross sections of the tip seal 300 and/or the seal groove 342 may be configured to have shapes other than a rectangular shaped cross section (e.g. a trapezoidal cross section). Generally, when the tip seal 300 is positioned in the seal groove 342, the seal groove 342 is larger than the tip seal 300, which creates the by-pass leakage 343. Generally, the tip seal 300 may include at least a seal side (e.g. the relatively smooth sides 310) along the length L to provide sealing with the seal wall 345 of the scroll wrap 330, where the seal side, e.g. 360, is pushed against the seal wall 345 in operation. In some embodiments, the seal side can be relatively smooth. The tip seal 300 may also include at least a gap side (e.g. the first or second sides 301, 302 of the tip seal 300) that faces sides 346, 347 of the groove 342. The gap side may be configured to include surface features 370 to provide resistance to, for example, a fluid flow flowing along the length L.

It is to be appreciated that generally, the tip seal 300 may include surface features, such as for example surface textures, surface structural elements, or a combination of both that can help provide resistance to a fluid flow flowing along the length L. In some embodiments, other structural elements and/or surface textures, such as for example depressions, apertures, trenches, protrusions, striations orientated perpendicular to a flow direction, sand textures, random patterns created by an etchant(s) or a bead blasting process, and bumps, in the tip seal 300 may also help provide resistance to the fluid flow flowing along the length L.

Figure 4A:
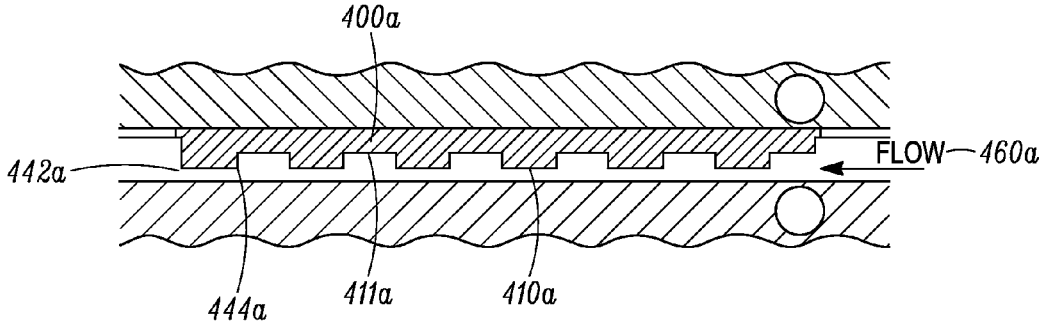
FIGS. 4A to 4D illustrate additional embodiments of tip seals installed in scroll wraps.
Figure 4B:
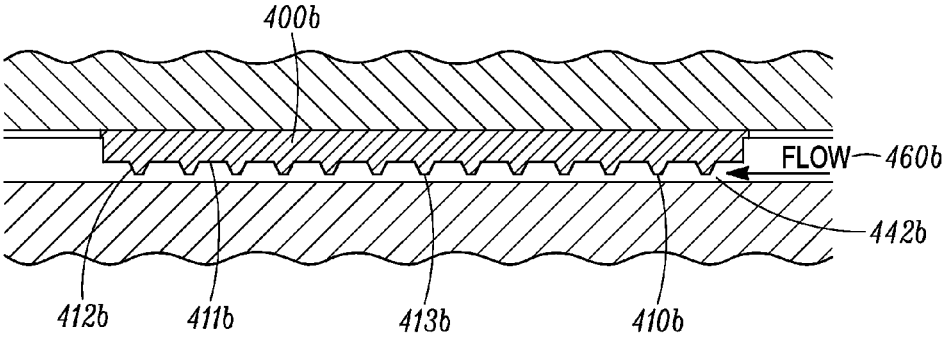
Figure 4C:
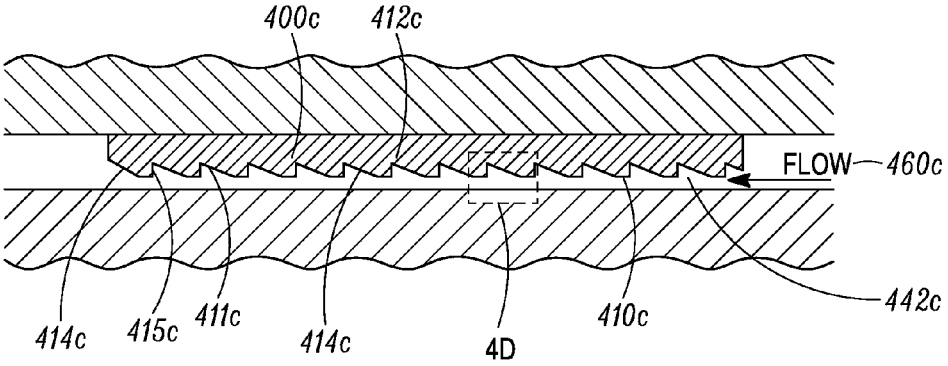

FIGS. 4A to 4C illustrate three different embodiments of surface features that can be included in tip seals 400*a*, 400*b* and 400*c* respectively. FIGS. 4A to 4C illustrate sectional views of the tip seals 400*a*-400*c* along, for example, a line 4A-4A as illustrated in FIG. 3B.

Generally, as illustrated in FIGS. 4A to 4C, the surface features can generally include a plurality of protruding structural elements 410*a*, 410*b* and 410*c* spaced apart by valleys 411*a*, 411*b* and 411*c* respectively. When a fluid flow 460*a*, 460*b*, 460*c* (illustrated by arrows in FIGS. 4A to 4C) flows through gaps 442*a*, 442*b* and 442*c* respectively, the protruding structural elements 410*a*, 410*b* and 410*c* can force the fluid flow 460*a*-460*c* to contract, while the valleys 411*a*, 411*b* and 411*c* can allow the fluid flow 460*a*-460*c* to expand. The contractions and expansions of the fluid flow 460*a*-460*c* can help provide resistance to the fluid flow 460*a*-460*c* when flowing in the gaps 442*a* to 442*c* respectively.

In some embodiments, as illustrated in FIG. 4A, the structural elements 410*a* can generally have a rectangular shaped cross section. In the illustrated embodiment, an angle 444*a* of the rectangular shaped cross section of the structural elements 410*a* is generally configured to face the fluid flow 460*a*.

In some embodiments, as illustrated in FIG. 4B, the structural elements 410*b* may generally have a tapered portion 412*b*. A top 413*b* of the structural elements 410*b* may have a flat portion, as illustrated in FIG. 4B. It is to be appreciated that the top 413*b* may not include a flat portion. In the illustrated embodiments, the structural elements 410*b* are spaced apart by valleys 411*b*.

In some embodiments, as illustrated in FIG. 4C, the structural elements 410*c* may generally have first and second portions 414*c* and 415*c* respectively. In some embodiments, the first and second portions 414*c* and 415*c* may be sloped, with the notion that one of the first and second portions 414*c*, 415*c* may not be sloped. In some embodiments, the portions 414*c* and 415*c* may be configured to have different degrees of slopes. As illustrated, the second sloped portion 415*c* may be relatively steeper than the first sloped portion 414*c*. The relatively steeper second sloped portion 415*c* may be configured to be oriented toward the fluid flow 460*c*.

Figure 4D:
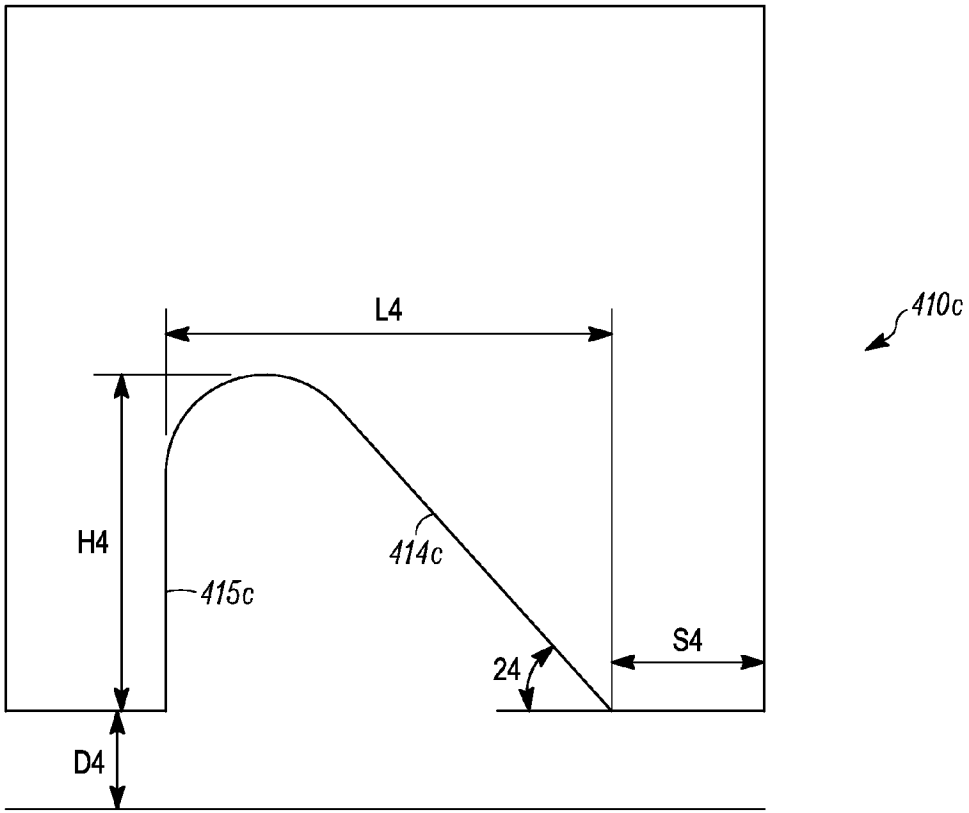

Referring to FIG. 4D, an enlarged view of area 4D in FIG. 4C is illustrated. The geometric features of the structural elements 410*c* can be defined by, for example, dimensions and/or slope angles of the first and second portions 414*c* and 415*c*. As illustrated in FIG. 4D, one of the structural elements 410*c* can be defined by a height H4, a length L4, a slope angle $\alpha 4$, a tooth length S4 between the illustrated structural element 410*c* to the neighboring structural element, and a distance D4 between the structural element 410*c* to a bottom 447*c* of a seal groove. It is noted that the dimensions and/or slope angle(s) can be optimized. For example, in some embodiments, a ratio of D4/S4 and/or a ratio of H4/L4 may affect the effectiveness and/or manufacturing process of the tip seal. For example, in some embodiments, if the D4/S4 is too small, effectiveness of the surface features may be reduced. In some embodiments, if the H4/L4 is too small, effectiveness of the surface features may be reduced. In some embodiments, if the D4/S4 and/or H4/L4 become too large, performance benefits of the surface features may also be reduced. Evaluation of the dimensions, slope angle(s) and ratios can help produce an optimal, preferred configuration. In some embodiments, the ratio of D4/S4 may be in the range of 0.05 to 0.20. In some embodiments, the ratio of H4/L4 may be in the range of 1.0 to 1.5.

It is to be appreciated that while FIG. 4D shows one embodiment of dimensions of a surface feature, such general dimensions can be applicable to any of the surface features described herein. For example, it is to be appreciated that any of the surface features described herein generally can have characteristics to define the dimensions and ratios thereof the surface features, such as for example one or more lengths L, widths W, heights H, and/or a slope angle(s) (e.g. $\alpha$). These can be optimized and/or evaluated to achieve a desired flow resistance effect.

Figure 5A:
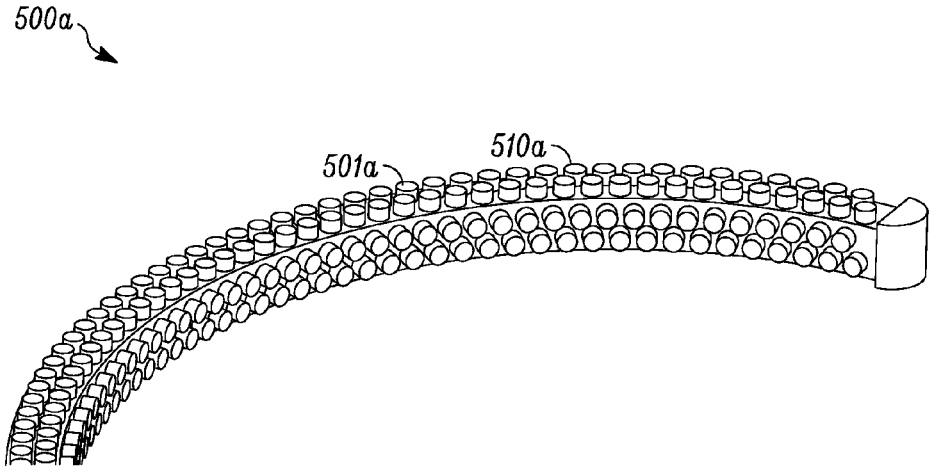
FIGS. 5A and 5B illustrate perspective views of two additional embodiments of tip seals.
Figure 5B:
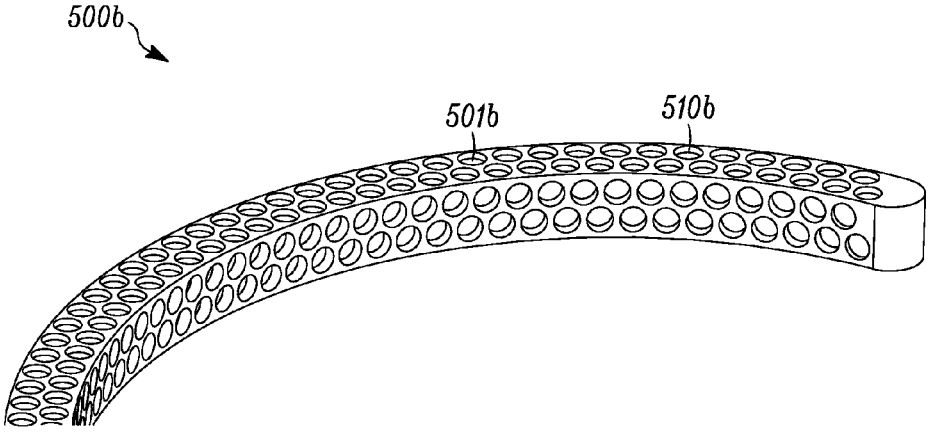

FIGS. 5A and 5B illustrate another two embodiments of seal tip 500*a*, 500*b* respectively. The seal tip 500*a*, 500*b* can have surface features in the form of structural elements 501*a*, 501*b* respectively. In FIG. 5A, the structural elements 501*a* may include a plurality of protrusions 510*a*. The protrusions 510*a* can have various geometries, shapes and dimensions (e.g. height, diameter). In the illustrated embodiment, the protrusions 501*a* generally have a column shape.

In FIG. 5B, the structural elements 501*b* may generally include a plurality of depressions 510*b*. The depressions 510*b* can have various shapes, geometries and dimensions (e.g. depth, diameter).

FIGS. 5A and 5B also illustrate that a tip seal (e.g. the tip seal 500*a*, 500*b*) can have more than one row of structural elements (e.g. the structural elements 501*a*, 501*b*) along a length of the tip seal (see the length L in FIG. 3A). In some embodiments, as illustrated in FIGS. 5A and 5B, the structural elements in each row may be positioned relatively offset along the length of the tip seal.

It is to be appreciated that the surface features as illustrated herein may be used separately or in combination. In some embodiments, the tip seal may include different types of surface features. Referring to FIG. 3A for example, in some embodiments, the configurations of the surface features of the tip seal 300 may vary along the length L. For example, a pitch, a frequency, shapes, dimensions and/or geometries of the surface features may vary along the length L. In some embodiments, the configurations (e.g. a pitch, a frequency, shapes, dimensions and/or geometries) of the surface features of the tip seal 300 may be relatively uniform along the length L. In some embodiments, the configuration (e.g. a pitch, a frequency, shapes, dimensions and/or geometries) of the surface features of the tip seal 300 may be progressively rough from one end (e.g. the first end 303) of the tip seal 300 to the other end (e.g. the second end 304) of the tip seal 300. For example, the roughness of the tip seal 300 may have a correlation with the pressure of the fluid flow. In some embodiments, the higher the pressure that may be present in the fluid flow (e.g. relatively close to the second end 304 in FIG. 3A), the relatively more rough the tip seal 300 in the corresponding locations. The term "roughness" generally refers to a property of the tip seal to provide resistance to a fluid flow. The more roughness correlates to more resistance when a fluid flows past the surface. In some embodiments, the roughness may be provided by a pitch or frequency of the surface features 312 on the tip seal 300. In some embodiments, the more surface features 312 that are present in a given area (e.g. more dense/frequency), the more rough the tip seal 300. It is appreciated that the roughness can also be provided by other properties of the surface features, e.g. surface textures, structures, structure material compositions, shapes, dimensions and/or geometries. It is understood, in some embodiments, one or more sides of the tip seal may be relatively smooth, or lack surface features that would create a tortuous flow path and may be otherwise suitable as sealing structures.

In some embodiments, the surface features (e.g. a shape, geometry and dimensions) may be optimized based on properties of the fluid flow (e.g. a pressure, a speed, and a flow rate). In some embodiments, the surface features may be optimized by computational fluid dynamic modeling. For example, a depth, a pitch and/or a geometry (sharpness of the surface features) of the surface features may be optimized to obtain a desired flow resistance.

In some embodiments, a method of sealing in a scroll compressor may include sealing between interfitting first and second wraps with a seal; and directing refrigerant flow to a tortuous flow path defined between the first and second wraps and the seal, and the tortuous flow path includes a plurality of contractions and expansions.

It is to be appreciated that the embodiments as disclosed herein can generally be used with any seal that may form a gap with a seal groove receiving the seal. The surface features can help prevent or at least reduce leakage through the gap.

Aspects

Any of aspects 1-8 can be combined with any of aspects 9-25. Any of aspects 9-15 can be combined with any of aspects 16-25. Any of aspects 16-23 can be combined with aspects 24-25. Aspect 24 can be combined with aspect 25.

Aspect 1. A tip seal for a scroll member in a scroll compressor, comprising:
- a first side along a length of the tip seal; and
- a second side along the length of the tip seal;
- wherein the first side includes surface features configured to provide resistance to a fluid flow when the fluid flow flows along the length of the tip seal, and the second side is configured to be pushed against a scroll member during operation of the scroll compressor to provide sealing.

Aspect 2. The tip seal of aspect 1, wherein the second side is relatively smooth compared to the first side.

Aspect 3. The tip seal of aspects 1-2, wherein the surface features includes a plurality of protruding structural elements.

Aspect 4. The tip seal of aspect 3, wherein the plurality of structural elements have a width, and the width of the plurality of protruding structural elements are substantially perpendicular to the length L.

Aspect 5. The tip seal of aspects 3-4, wherein the plurality of protruding structural elements are spaced apart along the length of the tip seal.

Aspect 6. The tip seal of aspects 3-5, wherein the plurality of protruding structural elements include a rectangular shaped cross section.

Aspect 7. The tip seal of aspects 3-5, wherein the plurality of protruding structural elements include a tapered portion.

Aspect 8. The tip seal of aspects 3-5, wherein a cross section of the plurality of protruding structural elements includes a sloped first side and a sloped second side, and the sloped first side is steeper than the sloped second side.

Aspect 9. A tip seal for a scroll member in a scroll compressor, comprising:
- a first side along a length of the tip seal; and
- a second side along the length of the tip seal;
- wherein the first side is a relatively rough side, and the second side is configured to be pushed against the scroll member and is a relatively smooth side.

Aspect 10. The tip seal of aspect 9, wherein the first side includes a plurality of protruding structural elements.

Aspect 11. The tip seal of aspect 10, wherein the plurality of structural elements have a width, and the width of the plurality of protruding structural elements is substantially perpendicular to the length L.

Aspect 12. The tip seal of aspects 10-11, wherein the plurality of protruding structural elements are spaced apart along the length of the tip seal.

Aspect 13. The tip seal of aspects 10-12, wherein the plurality of protruding structural elements include a rectangular shaped cross section.

Aspect 14. The tip seal of aspects 10-12, wherein the plurality of protruding structural elements include a tapered portion.

Aspect 15. The tip seal of aspects 10-12, wherein a cross section of the plurality of protruding structural elements includes a sloped first side and a sloped second side, and the sloped first side is steeper than the sloped second side.

Aspect 16. A scroll compressor, comprising:

a first scroll member;

a second scroll member; and a tip seal;

wherein the first scroll member includes a seal groove configured to receive the tip seal, the tip seal includes a relatively smooth side forming a seal with the second scroll member, the tip seal includes a relatively rough side facing a bottom of the seal groove.

Aspect 17. The scroll compressor of aspect 16, wherein the relatively rough side includes a plurality of protruding structural elements.

Aspect 18. The scroll compressor of aspect 17, wherein the plurality of structural elements has a width, and the width of the plurality of protruding structural elements is substantially perpendicular to the length L.

Aspect 19. The scroll compressor of aspects 17-18, wherein the plurality of protruding structural elements are spaced apart along the length of the tip seal.

Aspect 20. The scroll compressor of aspects 17-19, wherein the plurality of protruding structural elements include a rectangular shaped cross section.

Aspect 21. The scroll compressor of aspects 17-19, wherein the plurality of protruding structural elements include a tapered portion.

Aspect 22. The scroll compressor of aspects 16-19, wherein a cross section of the plurality of protruding structural elements include a sloped first side and a sloped second side, and the sloped first side is steeper than the sloped second side.

Aspect 23. The scroll compressor of aspects 16-22, wherein the tip seal, the first wrap and the second wrap define a tortuous flow path with a plurality of contractions and expansions.

Aspect 24. A method of providing sealing between interfitting first and second wraps in a scroll compressor, comprising:

sealing between interfitting first and second wraps with a seal; and directing refrigerant flow to a tortuous flow path defined between the first and second wraps and the seal, and the tortuous flow path includes a plurality of contractions and expansions.

Aspect 25. A scroll compressor, comprising:

a first scroll member;

a second scroll member; and a tip seal;

wherein the first scroll member includes a seal groove configured to receive the tip seal, the tip seal includes a relatively smooth side forming a seal with the second scroll member, the tip seal includes a relatively rough side facing a seal wall of the seal groove.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A method of providing sealing between interfitting first and second wraps in a scroll compressor, the method comprising:

sealing between the interfitting first and second wraps with a seal provided in a groove of the first wrap; and directing refrigerant flow to a tortuous flow path along a length of the seal defined between the first and second wraps and the seal, and the tortuous flow path includes a plurality of protruding structural features on the seal that each extend along both a first side and a second side of the seal, the first side facing a bottom surface of the groove of the first wrap and the second side facing a side surface of the groove of the first wrap, the plurality of protruding structural features forming contractions and expansions in a direction along the length of the seal for the refrigerant flow between the first side and second side of the seal and the bottom surface and side surface of the groove, respectively.

2. A tip seal for a scroll member in a scroll compressor, the tip seal comprising:

a first side along a length of the tip seal, the first side configured to face a bottom surface of a groove in a first scroll member, and the first side including a plurality of protruding structural elements configured to provide a tortuous path for fluid flow between the first side and the bottom surface of the groove in a direction along the length of the tip seal when the scroll compressor is operating; and a second side along the length of the tip seal, the second side configured to be pushed against a second scroll member during operation of the scroll compressor to provide sealing; and a third side along the length of the tip seal, the third side configured to face a side surface of the groove, the third side including a plurality of protruding structural elements configured to provide a tortuous path for fluid flow between the third side and the side surface of the groove in the direction along the length of the tip seal, wherein each of the plurality of protruding structural elements of the first side is directly connected to one of the plurality of protruding structural elements of the third side so as to provide a protruding structural feature that extends along both the first side and the third side.

3. The tip seal of claim 1, wherein the second side is relatively smooth compared to the first side.

4. The tip seal of claim 1, wherein each of the plurality of protruding structural elements of the first side extends across a width of the tip seal, the width of the tip seal being perpendicular to the length of the tip seal, and the plurality of protruding structural elements of the first side are spaced apart along the length of the tip seal.

5. The tip seal of claim 1, wherein the plurality of protruding structural elements of the first side include a rectangular shaped cross section.

6. The tip seal of claim 1, wherein the plurality of protruding structural elements of the first side include a tapered portion.

7. The tip seal of claim 1, wherein a cross section of the plurality of protruding structural elements of the first side includes a sloped first side and a sloped second side, and the sloped first side is steeper than the sloped second side.

8. The tip seal of claim 1, wherein each of the plurality of protruding structural elements of the third side extends across a width of the tip seal, and the plurality of protruding structural elements being spaced apart along the length of the tip seal.

9. A scroll compressor, comprising:

a first scroll member;

a second scroll member; and a tip seal;

wherein the first scroll member includes a seal groove configured to receive the tip seal, and the tip seal includes:

a relatively smooth side forming a seal with the second scroll member, and a first relatively rough side facing a bottom of the seal groove, the first relatively rough side including a plurality of protruding structural elements that provide a tortuous path for fluid flowing between the first relatively rough side and the bottom surface of the seal groove in a direction along a length of the tip seal, and a second relatively rough side facing a side surface of the seal groove, the second relatively rough side including a plurality of protruding structural elements that provide a tortuous flow path for fluid flowing between the second relatively rough side and the side surface of the seal groove in a direction along the length of the tip seal, wherein each of the plurality of protruding structural elements of the first relatively rough side is directly connected to one of the plurality of protruding structural elements of the second relatively rough side so as to provide a protruding structural feature that extends along both the first relatively rough side and the second relatively rough side.

10. The scroll compressor of claim 9, wherein each of the plurality of protruding structural elements of the first relatively rough side extends across a width of the tip seal, the width of the tip seal being perpendicular to the length of the tip seal, and the plurality of protruding structural elements of the first relatively rough side are spaced apart along the length of the tip seal.

11. The scroll compressor of claim 9, wherein the plurality of protruding structural elements of the first relatively rough side include a rectangular shaped cross section.

12. The scroll compressor of claim 9, wherein the plurality of protruding structural elements of the first relatively rough side include a tapered portion.

13. The scroll compressor of claim 9, wherein a cross section of the plurality of protruding structural elements of the first relatively rough side includes a sloped first side and a sloped second side, and the sloped first side is steeper than the sloped second side.

14. The scroll compressor of claim 9, wherein the tortuous flow path between the first relatively rough side and the bottom surface of the seal groove includes a plurality of contractions and expansions, and the tortuous flow path between the second relatively rough side and the side surface of the seal groove includes a plurality of contractions and expansions.

15. The scroll compressor of claim 9, wherein each of the plurality of protruding structural elements of the second relatively rough side extends across a width of the tip seal, and the plurality of protruding structural elements of the second relatively rough side being spaced apart along the length of the tip seal.

* * * * *